United States Patent [19]

Smoot et al.

[11] Patent Number: 4,521,776

[45] Date of Patent: Jun. 4, 1985

[54] RADIO PAGING DEVICE INCLUDING APPARATUS FOR PREVENTING UNDESIRED DEVICE TURN-OFF

[75] Inventors: George W. Smoot, Sunrise; Philip P. Macnak, Plantation, both of Fla.

[73] Assignee: Motorola, Inc., Schaumburg, Ill.

[21] Appl. No.: 432,229

[22] Filed: Oct. 1, 1982

[51] Int. Cl.[3] ..... G08B 5/22

[52] U.S. Cl. ..... 340/825.44; 340/825.54; 455/38

[58] Field of Search ..... 340/825.44, 311.1, 825.54, 340/825.45; 455/343, 38, 227

[56] References Cited

U.S. PATENT DOCUMENTS 4,369,443 1/1983 Giallanza et al. ..... 340/825.44

4,438,433 3/1984 Smoot et al. ..... 340/825.44

*Primary Examiner*—Ulysses Weldon

*Attorney, Agent, or Firm*—Joseph T. Downey; James W. Gillman; Edward M. Roney

[57] ABSTRACT

A radio paging device is provided which includes apparatus for preventing turn off of the paging device until all selective calling message signals which are stored in the pagers memory have been displayed. The pager of the present invention further includes apparatus for automatically initiating interrogation of the memory when the user attempts to turn off the paging device.

7 Claims, 6 Drawing Figures

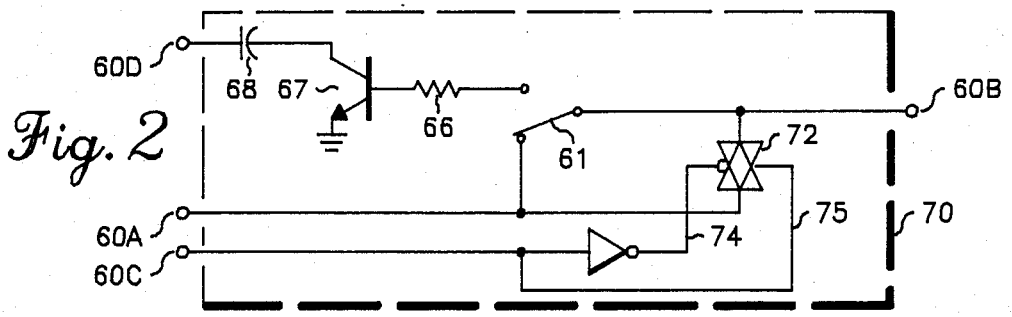
Fig. 2
Fig. 3
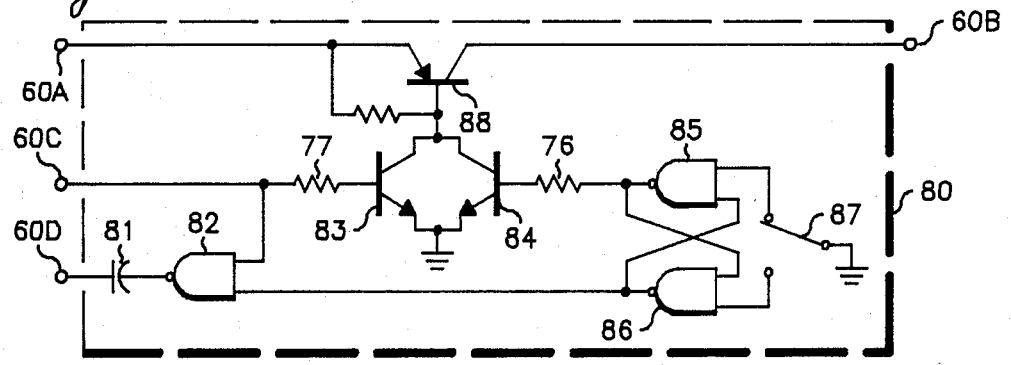
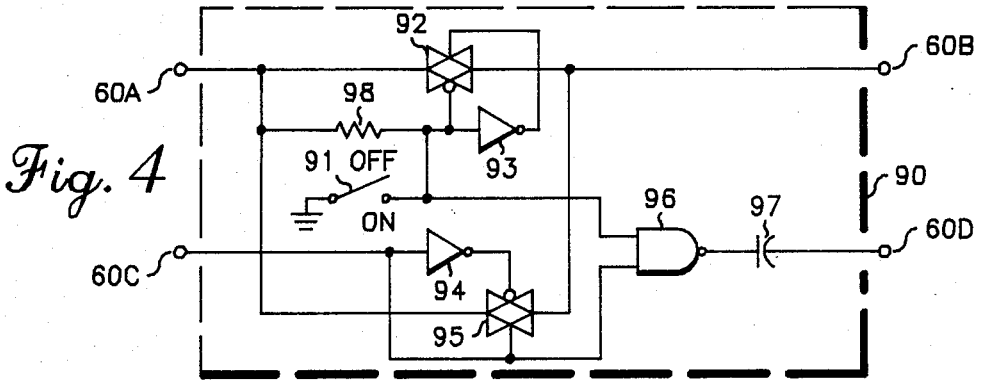
Fig. 4
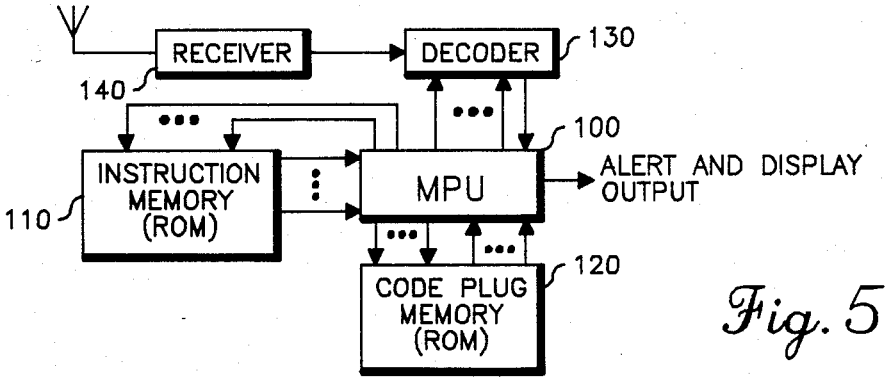
Fig. 5

RADIO PAGING DEVICE INCLUDING APPARATUS FOR PREVENTING UNDESIRED DEVICE TURN-OFF

BACKGROUND OF THE INVENTION

This invention relates to radio paging devices and more particularly to radio paging devices in which received selective calling messages are stored for later interrogation by the user.

DESCRIPTION OF THE PRIOR ART

Radio paging devices, that is selective calling devices, are known to those skilled in the art. Such radio paging devices typically include a radio receiver for receiving transmitted selective calling message signals and further include a decoder such that the radio paging device is responsive only to coded selective calling signals intended for a particular device and user.

Some of the more conventional radio paging devices merely provide a tone alert signal to the user when someone attempts to page the user. These are the so called tone-only pagers. Upon hearing the alert tone, the user calls a telephone number at which a central dispatcher or operator informs the user of the identity of the party who is attempting to locate him. It is apparent that such systems offer limited flexibility.

A more advanced radio paging device is the tone and voice type pager which provides the user with an alert signal and an actual voice message when the user is paged.

A still more modern type of radio paging device is the Multi-address Pager With A Call Storage and Priority Paging Option described and claimed in the U.S. patent application Ser. No. 306,799, of Smoot et al. filed on Sept. 29, 1981, now U.S. Pat. No. 4,438,433, which is co-pending with this application and is assigned to the instant assignee. The contents of application Ser. No. 306,799 are incorporated herein by reference. Typically, such radio paging devices include a receiver for receiving selective calling message signals. An appropriate decoder apparatus is coupled to the receiver to assure that only selective calling messages intended for the user of the particular paging device are processed by the paging device. The pager appropriately alerts the user that a selective calling message is received. This is accomplished by actuating one of a plurality of annunciators (lights, or different frequency tones, for example) each of which corresponds to a different telephone number or person that the user should call.

If the user so desires, the received selective calling messages need not be immediately provided output at the appropriate annunciator. Rather, the selective calling message is stored at an appropriate location in a memory. Later, at the convenience of user of the paging device, the user actuates a switch to interrogate the memory and cause the deferred stored messages to be provided output to alert the user that he has been paged.

The increased flexibility of such a paging device is apparent. For example, when the user attends a meeting, the attendees at the meeting, as well as the user need not be disrupted by reception of a selective calling message.

One problem associated with such radio paging devices is that users are prone to turning off the paging device without having first interrogated and read out the received selective calling messages stored in memory. Thus, several selective calling messages intended for the user are potentially lost.

It is one object of the present invention to provide a radio paging device which includes apparatus for preventing turn-off of the paging device until any selective calling messages which are stored in memory have been provided output.

Another object of the present invention is to provide a radio paging device which includes apparatus for automatically initiating interrogation of the memory when the user attempts to turn off the paging device.

These and other objects of the invention will become apparent to those skilled in the art upon consideration of the following description of the invention.

BRIEF SUMMARY OF THE INVENTION

The present invention is directed to providing a radio paging device including apparatus for preventing turn off of the device until all selective calling messages stored in the device have been interrogated and provided output to the user.

In accordance with one embodiment of the invention, a radio paging device includes a receiver for receiving radio frequency selective calling messages signals transmitted over a communications channel. A decoder is coupled to the receiver for detecting when selective calling message signals intended for the device are received. A memory is coupled to the decoding device for storing such selective calling message signals. An interrogation circuit is coupled to the memory for interrogating the memory upon command of the user of the paging device to provide output of the selective calling message signals stored in the memory in a form understandable to the user. A power supply provides power to the radio paging device. A user actuable switch is operatively coupled to the power supply by selectively switching power to the paging device. A memory checking circuit is coupled to the memory and the user actuable switching circuit for determining if any unread selective calling message signals remain in the memory when the user attempts to turn off the device. A turn-off prevention circuit is coupled to the memory checking circuit and the switching circuit for preventing turn-off of the device if the memory checking circuit determines that unread selective calling message signals remain in the memory when the user attempts to turn-off the device.

The features of the invention believed to be novel are set forth with particularity in the appended claims. The invention itself, however, both as to organization and method of operation, together with further objects and advantages thereof, may best be understood by reference to the following description of taken in conjunction with the accompanying drawings.

DESCRIPTION OF THE DRAWINGS

FIG. 2 is a schematic diagram of one turn-off prevention circuit which may be employed in the radio paging device of FIG. 1.

FIG. 3 is a schematic diagram of another turn-off prevention circuit which may be employed in the radio paging device of FIG. 1.

FIG. 4 is a schematic diagram of yet another turn-off prevention circuit which may be employed in the radio paging device of FIG. 1.

FIG. 5 is a block diagram of the radio paging device of the present invention implemented in microprocessor form.

DETAILED DESCRIPTION OF THE PREFERRED EMBODIMENT

Understanding of the present invention may be facilitated by referring to the above incorporated Smoot et al. patent application which describes and claims a radio paging device similar to the one hereafter described but without the turn-off prevention feature and other features of the present invention. For sake of completeness, the portions of the FIG. 1 pager which are similar to the disclosure of the above incorporated Smoot et al. patent application will be briefly discussed presently.

Figure 1:
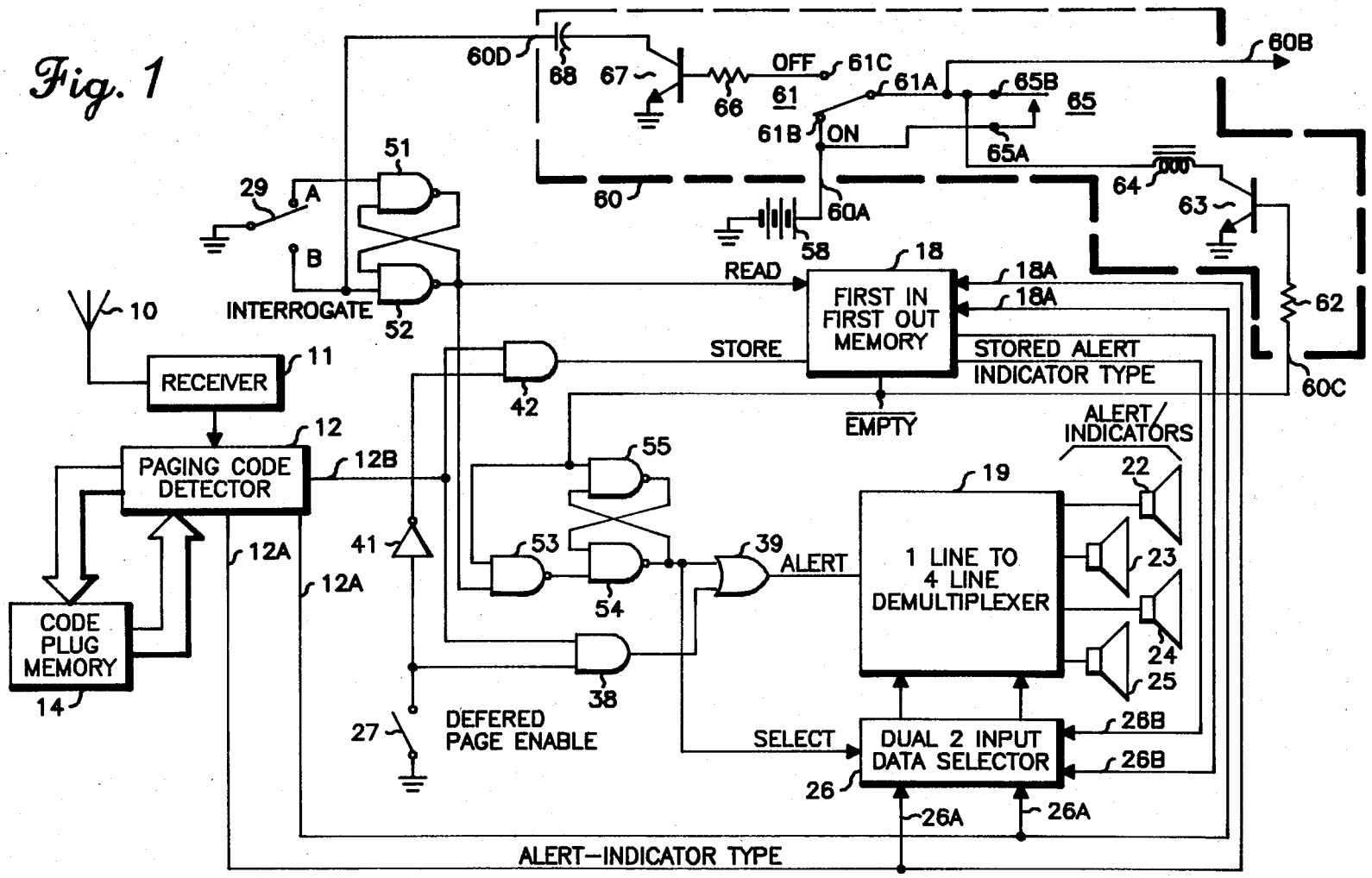
FIG. 1 is a detailed blocked diagram of one embodiment of the radio paging device of the present invention.

The pager of FIG. 1 includes an antenna 10 coupled to a receiver 11 which receives selective calling message signals transmited over a radio frequency communications channel. A paging code which is unique to the particular pager which is to be activated is transmitted typically immediately prior to the aforementioned selective calling signal. Receiver 11 receives the paging codes and the selective calling signal following thereafter.

A paging code detector 12 is coupled to receiver 11 as seen in FIG. 1. A code plug memory 14 is operatively coupled to paging code detector 12 such that when receiver 11 receives paging codes and corresponding selective calling signals, paging code detector 12 actuates code plug memory 14 and reads the unique coded contents thereof into detector 12. If the received paging code matches the unique paging code read into detector 12 from code plug memory 14, then the selective calling message associated with such received paging code is provided output at paging code detector outputs 12A which are coupled to the inputs 26A of dual two-input data selector 26 and to the data inputs 18A of a first in, first out memory 18. Further, when such paging code is detected by detector 12, detector output 12B changes from a logical 0 state to a logical 1 state.

It is noted that the pager of FIG. 1 has the capability of storing selective calling message signals in memory 18 or providing them to the multiplexer 19 for readout according to the state in which dual two-input data selector 26 is set. More specifically, whether the selective calling message signal is stored in memory 18 for later readout or is immediately passed to alert indicators (annunciators) 22, 23, 24 or 25 via 1 line to 4 line demultiplexer 19 depends upon the logic state presented to the SELECT terminal of selector 26.

When deferred page enable switch 27 is in the open state as seen in FIG. 1, the radio paging device operates in a normal fashion in which received selective calling message signals are immediately provided output at selected ones of alert indicators 22–25 which typically comprise lights, light emitting diodes, speakers, or other annunciators. Alternatively, if deferred page enable switch 27 is closed, the received selective calling message signals are stored in memory 18 for later display as will be discussed in more detailed subsequently.

Returning to the case under discussion where deferred page enable switch 27 is in the open state, the input of AND gate 38 coupled thereto is presented with a logical 1 input state. When paging code detector 12 detects the correct paging code for the display paging device of FIG. 1, detector output 12B changes from a logical 0 state to a logical 1 state which causes the remaining input of AND gate 38 to be raised to a logical 1 state. Thus, the output of AND gate 38 becomes a logical 1. The output of AND gate 38 is coupled to one input of a two input OR gate 39. Thus, the output of OR gate 39 switches to a logical 1 state when the correct paging code is detected by detector 12. The output of OR gate 39 is coupled to the ALERT input of the multiplexer 19 such that when the correct paging code is received, an alert signal is provided to an appropriate one of alert indicators 22–25. The SELECT input of data selector 26 is provided an appropriate logic state such that the indicator type and message signals passing out detector outputs 12A are provided selector inputs 26A through selector 26 to the multiplexer 19 where the appropriate indicator (23–25) is selected according to the incoming alert indicator type data provided thereto. The user is thus immediately alerted as to the appropriate action to take according to which one of the indicators (annunciators) 22–25 is actuated.

Alternatively, if deferred page enable switch 27 is in the closed state, selective calling message signals are provided to memory inputs 18A. Such selective calling message signals are stored, that is deferred for later readout, in memory 18 when the "STORE" input of memory 18 assumes a logical 1 state. This occurs when the paging code detector 12 detects the correct code for the particular paging device and when deferred page enable switch 27 is closed. More specifically, when the pager detects a proper code prior to a selective calling message, the 12B output of detector 12 assumes a logical 1 state which is provided to one input of a two-input AND gate 42. The remaining input of AND gate 42 assumes a logical 1 state when deferred page enable switch 27 is closed by action of inverter 41 coupled therebetween. Thus, under these conditions wherein both inputs of AND gate 42 exhibit a logical 1 input state, the output of AND gate 42 is a logical 1 which is provided to the "STORE" input of memory 18. Memory 18 thus stores selective calling message signals for later readout when so instructed by the deferred page enable switch 27.

Once the selective calling message is stored in memory, the pager user may desire to continue such storage and to defer message readout. Alternatively, the user may desire to interrogate memory 18 to determine if any selective calling message signals have been stored therein while deferred page enable switch 27 was switched to the deferred page mode. To initiate such interrogation and readout of memory 18, the pager user switches switch 29 from position A (do not interrogate) to position B (interrogate). This causes the switch debouncing circuit formed by NAND gates 51 and 52 connected together in flip-flop configuration to generate a logical 1 output state.

Thus, when the user switches switch 29 to position B (interrogate) a logical 1 is provided to the read input of memory 18. When this condition happens, two things occur in memory 18. First, it is noted that the $\overline{\text{EMPTY}}$ output of memory 18 continuously indicates the status of deferred selective calling message signals by signaling a logical 0 if no selective calling message signals have been stored or a logical 1 if one or more selective calling message signals have been stored in memory 18. Thus, when switch 29 is swiched to the interrogate position, after deferred selective calling message signals have been stored in memory 18, the $\overline{\text{EMPTY}}$ output of memory 18 assumes a logical 1 state. This logical 1 is applied to a modified RS flip-flop circuit formed NAND gates 53, 54 and 55 coupled together as shown in FIG. 1. At the same time this logical 1 $\overline{\text{EMPTY}}$ signal is applied to flip-flop circuit 53, 54, and 55, the logical 1 interrogate command signal from interrogate circuit 51–52 is also provided to another input of modified flip-flop circuits 53, 54 and 55. When these conditions occur, an appropriate logic signal is provided to one input of OR gate 39 such that the output of OR gate 39 assumes a logical 1 output state which is provided to the ALERT input of demultiplexer 19 as shown in FIG. 1. This causes an appropriate one of alert indicators 22–25 to sound a tone or flash a light to indicate the action the pager user should take.

As seen in FIG. 1 the logical signal from the output of NAND gate 54 which indicates that a selective calling message signal is stored in memory 18 and that the user desires to interrogate such memory is provided to the select input of dual two-input data selector 26. When this occurs, the stored alert (message signal) and indicator type output lines of memory 18 are coupled through selector input 26B to demultiplexer 19 via data selector 26. Thus, the selective calling message is provided to demultiplexer 19 which switches the selective calling message signals to an appropriate one or more of alert indicators 22–25.

It is noted that the description of the pager operation given above is general in nature. More details of the pager operation are found in the above incorporated co-pending patent application. However, in accordance with the present invention, the pager of FIG. 1 includes an undesired turn-off prevention circuit 60 which prevents turn-off of the pager until all deferred selective calling messages stored in memory 18 are interrogated, read from memory and appropriately provided output. More specifically, an electrical battery for supplying power to the paging device of FIG. 1 is coupled to an input 60A of turn-off prevention circuit 60. Circuit 60 includes a single pole/double throw on/off power switch 61 including a common terminal 61A and wiper terminals 61B and 61C. Power switch 61 is employed to provide power to the various circuits of the pager of FIG. 1 in accordance with the subsequent discussion. When power switch 61 is actuated such that the wiper contacts terminal 61B, energy flows from the battery 58 through input 60A through switch 61 and to circuit output 60B which is coupled to the various circuits of the pager which require electrical energy from the battery 58 power supply in order to function. Thus, simply speaking, the pager is in a turned-on state.

The $\overline{\text{EMPTY}}$ output of memory 18 is coupled to an input 60C of circuit 60. Input 60C is coupled via a bias resistor 62 to the base of a switching transistor 63. The emitter of transistor 63 is coupled to ground. The collector or transistor 63 is coupled via the energizing coil 64 of a relay 65 to switch battery power supply output 60B. Relay 65 includes power contacts 65A and 65B which are coupled to circuit input 60A and circuit output 60B, respectively.

This provides an alternate path for power supply energy to travel between input 60A and output 60B. This alternate current path is provided whenever memory 18 obtains a deferred selective calling message therein as indicated by the $\overline{\text{EMPTY}}$ output thereof exhibiting a logical 1 output state. More specifically, when the $\overline{\text{EMPTY}}$ output of memory 18 assumes a logical 1 state indicating a deferred message stored therein, transistor 63 is turned on causing current to flow through relay coil 64. This actuates relay 65 such that contact 65A and 65B make electrical connection to each other. Thus, under these conditions, an alternate electrical path is provided for the power supply energy from battery 58 to travel from circuit input 60A to circuit output 60B and the pager circuitry coupled thereto. It is seen that when power switch 61 is turned on such that the pager is turned on, the primary electrical path of power supply battery 58 to the various circuits of the pager is from input 60A directly through power switch 61 to output 60B.

Thus, under these conditions when the user of the pager turns power switch 61 from the on position to the off position (connecting common terminal 61A to wiper terminal 61C) the alternative electrical power path through the relay 65 circuit continues to provide battery energy to the various circuits of the pager as long as the $\overline{\text{EMPTY}}$ output of memory 18 exhibits a logical 1 indicating that selective calling messages remain stored in memory 18. Thus, the radio paging device of FIG. 1 is not undesirably turned-off when the user turns off power switch 61 in the situation where uninterrogated paging messages remain in memory 18.

Switch terminal 61C is coupled via a resistor 66 to the base of a transistor 67. The emitter of transistor 67 is coupled to ground and the collector of transistor 67 is coupled via a capacitor 68 to circuit output 60D. Circuit output 60D is coupled to interrogate switch contact 29B of the interrogation circuit formed by NAND gates 51 and 52 and switch 29. Thus, when a pager user turns power switch 61 to the off position at terminal 61C the voltage across capacitor 68 is momentarily discharged to ground through transistor 67 before climbing again to a high logic value. Thus, when the paging device user turns power switch 61 off, switch terminal 29B is momentarily pulled to ground such that interrogation of memory 18 commences substantially in the same manner as if the user had actually depressed interrogate switch 29 to position B (ground).

Under these conditions the READ terminal of memory 18 receives a logical 1 from the interrogation circuit 51, 52. Then, in the manner already discussed in the description of the deferred page mode, the user is alerted by an appropriate tone or other signal at one of alert indicators 22–25. It will be appreciated that turn-off prevention circuit 60 causes such readout of deferred selective calling message signals to continue until all of such message signals have been provided to indicators 22–25 for observation by the user.

When all of the selective calling message signals which where deferred and stored in memory 18 have been provided output, then the $\overline{\text{EMPTY}}$ output of memory 18 assumes a logical 0 state which causes relay 64 to turn off. This removes the alternative power supply path between circuit input 60A and circuit output 60B provided by relay 65. All power is thus removed from the circuits of the radio paging device of FIG. 1 such that the device assumes a turned-off state until the user returns the power switch to the on-position.

FIG. 2 illustrates a turn-off prevention circuit 70 which is substituted in place of circuit 60 of FIG. 1 in radio paging devices in which less power consumption is desired. The input-output nomenclature of circuit 60 of FIG. 1 is retained in labeling the inputs and outputs of circuit 70 of FIG. 2 for ease of substitution and understanding. Circuit 70 of FIG. 2 is similar to circuit 60 of FIG. 1 with the following modifications. A CMOS transmission gate 72 is employed in place of relay 65 of FIG. 1. The $\overline{\text{EMPTY}}$ signal (logical 1 state) travels via 60C of circuit 70 via inverter 74 and line 75 to the respective gate of transmission gate 72 to turn such transmission gate on whenever the $\overline{\text{EMPTY}}$ signal exhibits a logical 1 indicating that memory 18 contains deferred pages. Under these conditions, a battery power supply connected to input 60A of circuit 70 has a primary current path through switch 61 (on position) to output 60B of the same figure. Further, a secondary alternative current path exists between input 60A and output 60B via transmission gate 72. Circuit 70 of FIG. 2 performs similarly to circuit 60 of FIG. 1 when switch 61 is turned to the off position by the user. Thus, when switch 61 of FIG. 2 is switched to the off position, interrogation, readout and output of any selective calling message signals stored in memory 18 commences. Power is not withdrawn from the circuitry of the radio paging device until all of such selective calling message signals are displayed.

FIG. 3 illustrates a turn-off prevention circuit 80 which may be employed in place of turn-off prevention circuit 60 of FIG. 1. The inputs and outputs of circuit 80 employs the same nomenclature as those of circuit 60 of FIG. 1 for ease of substitution and understanding. Circuit 80 operates in the following manner.

NAND gates 85 and 86 form a flip-flop circuit whose operational power is obtained continuously from the pager battery 58. When ON/OFF switch 87 is in the on-position, the input of NAND gate 85 to which it is connected exhibits a logical 0 input thus causing the output of NAND gate 85 to be logical 1. This logical 1 output is applied to the base of NPN transistor 84 through bias resistor 76. Since the emitter terminal of NPN transistor 84 is connected to ground, the logical 1 input on its base terminal causes its collector terminal to sink current. As the collector terminal of NPN transistor 84 is connected to resistor 89 and the base terminal of PNP transistor 88, current is drawn through these circuit elements causing an even larger current flow to occur from input 60A to the emitter terminal of PNP transistor 88 and from this point to the collector terminal of PNP transistor 88, the output 60B and the switched circuits of the pager, thus supplying power to the pager.

If the $\overline{\text{EMPTY}}$ signal which is connected to input 60C should become a logical 1, then one of the inputs of NAND gate 82 becomes a logical 1 and this same signal being coupled to bias resistor 77, whose remaining terminal is connected to the base terminal of NPN transistor 83, causes the collector terminal of transistor 83 to sink current. Since the collector terminal of NPN transistor 83 is directly connected to the collector terminal of NPN transistor 84, it is seen that with the $\overline{\text{EMPTY}}$ signal assuming a logical 1 state, the current sunk through the collector terminal of NPN transistor 83 would cause power to be supplied to the switched circuits of the pager even if NPN transistor 84 ceased to sink current though its collector terminal.

Should ON/OFF switch 87 be moved to the off position while $\overline{\text{EMPTY}}$ is a logical 1, then a logical 0 input to NAND gate 86 causes the output of NAND gate 86 and the input of NAND gate 82 connected to it to become a logical 1. The two inputs of NAND gate 82 being a logical 1 will cause the output of NAND gate 82 to become a logical 0 thus momentarily connecting output 60D to ground and starting interrogation.

FIG. 4 shows yet another turn-off prevention circuit 90 which may be employed in place of turn-off prevention circuit 60 of FIG. 1. Again, for convenience nomenclature used to described the inputs and outputs of circuit 90 is the same as that employed to describe the inputs and outputs of circuit 60 of FIG. 1. Turn-off prevention circuit 90 of FIG. 4 operates in the following manner.

Logic elements 91 through 96 are fabricated using the standard low power CMOS process and receive power from the pager battery continuously. When ON/OFF switch 91 is in the off-position a logical 1 (the battery 58 voltage) is applied through resistor 98 to the transmission gate formed by gate 92 and inverter 93 which act together to prohibit current flow between 60A and 60B.

In the on-position, ON/OFF switch 91 causes a logical 0 to be applied to transmission gate 92/93 allowing current to flow between 60A and 60B. This logical 0 signal is also applied to one of the inputs of NAND gate 96. If the EMPTY signal connected to input 60C should become a logical 1, then this logical 1 signal is applied to the control input of transmission gate 94/95 allowing current to flow between 60A and 60B. This logical 1 signal is also applied to the input of NAND gate 96 connected to 60C.

Should the ON/OFF switch 91 now be switched to the off-position, transmission gate 94/95 should allow current to flow between 60A and 60B thus prohibiting pager turn-off. The logical signal now applied to transmission gate 92/93 and the input of NAND gate 96 connected to ON/OFF switch 91 in combination with the logical 1 signal on the other input of NAND gate 96 would cause the output of NAND gate 96 to become a logical 0. The coupling momentarily of this logical 0 signal through capacitor 97 to output 60D causes interrogation to commence as already described above.

Above is described in detailed a number of embodiments of the pager of the present invention primarily in hard wire logic circuitry as shown in FIGS. 1–4. This pager can be implemented, however, as shown in the functional block diagram form of FIG. 5, using microprocessors which are widely available. Obvious advantages gained by the utilization of microprocessors are that the pager can be made smaller in size, more versatile, and can include more functions. The microprocessor version is software programable so that by changing certain of the programs stored in the memory, the functions of the pager can be modified, expanded or changed.

In accordance with the present invention, the microprocessor version of the pager includes a microprocessor MPU 100, an associated instruction memory 110 (read only memory—ROM) and code plug memory 120 (ROM), all operatively coupled together as shown in FIG. 5. An external decoder 130 is employed to signal the microprocessor 100 that a desired paging code has been received by receiver 140.

Microprocessor 100, associated instruction memory 110 and code plug memory 120 are operatively programmed and coupled to prevent turn-off of the pager of FIG. 5 if any deferred selective calling message signals remain in storage for deferred readout and output to the user. Such programming provides that the pager remains in an on state until all of the deferred selective calling message signals thus stored are appropriately read out to the user. The present invention is implemented by use of the model 146805E2 microprocessor manufactured by Motorola, Inc. In this particular implementation, microprocessor 100 reads instructions from the instruction memory 110, thus performing a sequence of steps resulting in a desired operation. An example of the sequence of operation required to accomplish the desired operation of this invention is shown in a functional flow chart in FIG. 6.

Figure 6:
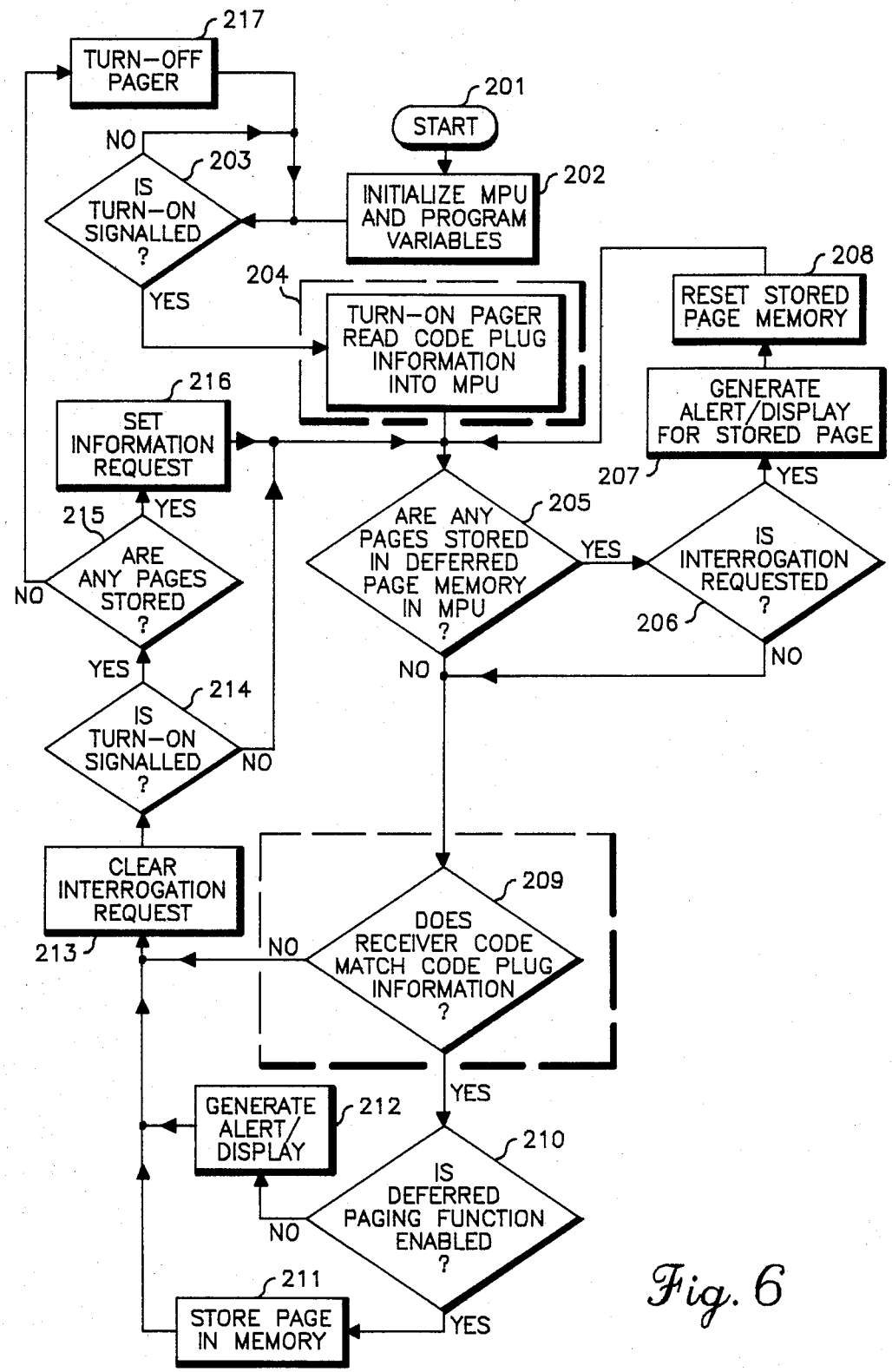
FIG. 6 is a flow chart of the operation of the present invention as implemented in either hard wire or microprocessor form.

FIG. 6 shows a flow chart in a conventional form which indicates the operational sequence of steps implemented by microprocessor 100. Since the operations depicted in the flow chart are shown in a well known conventional form, a detailed step by step description of each of the functions and decision blocks is omitted here. However, some of the major functions which are relevant to the invention are briefly described.

Referring to FIG. 6, flow chart blocks 201, 202, 203 and 204 prepare microprocessor 100 to perform the operation including pager turn-on. Flow chart blocks 205, 206, 207 and 208 perform the interrogate function. Blocks 209, 210, 211 and 212 perform the deferred page storage and generation of alert and output functions.

The present invention is primarily concerned with prevention of turn-off of the pager while selective calling messages or pages are stored in memory due to activation of the deferred paging function feature. Thus, the operation of the pager subsequent to decision block 210 which determines whether the deferred paging function is enabled will be presently discussed. For purposes of such discussion, it will be assumed that the deferred paging function is enabled such that decision block 210 reaches a yes decision resulting in the storage of the deferred page or selective calling message signal in memory in accordance with block 211.

Subsequent to block 211, block 213 provides that interrogation request is cleared. After executing block 213, decision block 214 tests to see if the user is signaling for the pager to be turned off. If the answer is affirmative, the program proceeds subsequently to decision block 215 to determine if any pages are stored. If it is determined affirmatively that pages are stored in memory, decision block 215 proceeds to block 216 which sets the interrogation request to initiate interrogation and display of all pages in memory prior to permitting turn-off of the pager in accordance with subsequent functional blocks. After the memory has been sufficiently interrogated such that no more pages remain in memory, then decision block 215 will determine that no more pages remain in memory and the program proceeds to block 217 at which power to the pager is turned off.

The foregoing describes a radio pager device in both hard wired and microprocessor form which includes apparatus for preventing turn-off of the paging device until all selective calling messages which where deferred and stored in memory are provided output to the user. The radio paging device includes apparatus for automatically initiating interrogation of the memory when the user attempts to turn-off the paging device.

While only certain perferred features of the invention have been shown by way of illustration, many modifications, and changes will occur to those skilled in the art. It is, therefore, to be understood that the present claims are intended to cover such modifications, and changes as fall within the true spirit of the invention.

What is claimed is:

1. A radio paging device comprising:

receiving means, for receiving radio frequency selective calling message signals transmitted over a communications channel;

decoding means, coupled to said receiving means, for detecting when selective calling message signals intended for said device are received;

memory means, coupled to said decoding means, for storing said selective calling message signals;

interrogation means, coupled to said memory means, for interrogating said memory means upon command of the user of said paging device to provide output of the selective calling messages signals stored in said memory means in a form understandable to the user;

power supply means, for providing power to said radio paging device;

user actuable switching means, operatively coupled to said power supply means, for selectively switching power to said paging device;

memory checking means, coupled to said memory means and said switching means, for determining if any unread selective calling message signals remain in said memory means when the user attempts to turn off the device, and turn off prevention means, coupled to said memory checking means and said switching means, for preventing turn off of said device if said memory checking means determines that unread selective calling message signals remain in said memory means when the user attempts to turn off the device.

2. The radio paging device of claim 1 including automatic interrogation actuation means, coupled to said memory means and said switching means, for initiating interrogation and readout of selective calling message signals remaining in said memory means whenever the user attempts to turn off said paging device.

3. The radio paging device of claim 1 including display means operatively coupled to said decoding means and memory means, for displaying selective calling message signals intended for reception by said device.

4. The radio paging device of claim 2 including display means operatively coupled to said decoding means and memory means, for displaying selective calling message signals intended for reception by said device.

5. The radio paging device of claim 1 including alerting means, operatively coupled to said memory checking means, for actuating an alerting apparatus to alert the user that unread selective calling message signals remain stored in said memory means at the time the user attempts to turn off said paging device.

6. The radio paging device of claim 1 wherein said interrogation means includes a manually actuable switch capable of initiating interrogation and readout of the selective calling message signals stored in said memory means.

7. The radio paging device of claim 5 wherein said interrogation means includes a manually actuable switch capable of initiating interrogation and readout of the selective calling message signals stored in said memory means.

* * * * *